United States Patent [19]

Bock

[11] Patent Number: 4,537,360

[45] Date of Patent: Aug. 27, 1985

[54] STREAM-CONTROLLING DEVICE FOR FAUCETS

[75] Inventor: Robert E. Bock, Woodbury, Conn.

[73] Assignee: WPM, Inc., Waterbury, Conn.

[21] Appl. No.: 496,521

[22] Filed: May 20, 1983

[51] Int. Cl.[3] ..... B05B 1/14

[52] U.S. Cl. ..... 239/553.3; 239/558

[58] Field of Search ..... 239/548, 553, 553.3, 239/553.5, 461, 600, 556–559

[56] References Cited

U.S. PATENT DOCUMENTS 2,383,433 8/1945 Burnam ..... 239/553.3

3,322,352 5/1967 Alcantara ..... 239/461

*Primary Examiner*—Andres Kashnikow

*Assistant Examiner*—James R. Moon, Jr.

*Attorney, Agent, or Firm*—Davis, Hoxie, Faithfull & Hapgood

[57] ABSTRACT

In a stream-controlling device for faucets, water from the faucet passes through a first flow-restricting orifice in a circular flow restrictor mounted in a casing secured to the faucet, the restrictor having a conical wall portion sloping downwardly and inwardly toward the orifice. From the latter water enters a chamber between the restrictor and the casing's bottom wall, the latter having opposite the orifice a recess with a conical surface which deflects the water radially outward through an annular second flow-restricting orifice formed by the bottom wall and the lower end of the restrictor's conical wall. From this second orifice, which has a larger throughflow area than the first orifice, water enters an annular subchamber having a substantially enlarged volume due to the restrictor's conical wall. The water is then divided so that part of it discharges through a radially inner set of holes in the bottom wall and the remainder through an outer set of holes, these holes collectively constituting a third flow-restricting orifice having a larger throughflow area than the second orifice.

6 Claims, 2 Drawing Figures

STREAM-CONTROLLING DEVICE FOR FAUCETS

FIELD OF INVENTION

This invention relates to a stream-controlling device which may be installed on the end of a kitchen or bathroom faucet to control the rate of discharge and to qualify the discharge into a straight stream suitable for kitchen and bathroom uses.

BACKGROUND OF THE INVENTION

Many faucets are equipped at their discharge ends with faucet aerators. The functions of such aerators have been to introduce air into the discharge stream in order to minimize splashing, to qualify the discharge of the spout into a straight stream and, finally, in more recent years to limit the flow rate from the spout to nationally accepted flow rate standards.

In some instances, simpler devices known as stream straighteners have also been used on faucets. These devices do not introduce air into the stream and tend to be less than satisfactory in straightening up the discharge. Finally, these devices have not been designed to limit flow rates to recently adopted national standards.

A major difficulty with existing stream straighteners is their inability to bring the discharge stream into an acceptable straight discharge. This results from changes in the methods used to manufacture faucets in recent years. These changes are of such a nature as to greatly disturb the discharge from the faucet, causing violent turbulence. It is well known that if the aerator or stream straightener is removed from many faucets, the discharge is completely unacceptable and, in some cases, tends to spray out into a large cone shape.

Stream straighteners presently available on the market are not capable of restricting flow rates to currently accepted national flow rate standards. These stream straighteners do not include a flow restrictor. Therefore, the only way to reduce the flow through this type of stream straightener is to reduce the size of each individual discharge hole on the bottom of the straightener. This becomes impractical as the size of each such discharge hole must be reduced to such a small diameter that manufacturing expense and quality control problems become severe.

An object of this invention is to provide a stream straightening device which is of simpler construction and, therefore, lower cost than an aerator. Another object is to improve the straightness and quality of the discharge. Still another object is to control the discharge rate in order to meet the required flow rate standards.

BRIEF SUMMARY OF THE INVENTION

The device of the invention includes a generally cylindrical hollow casing having discharge holes in its bottom wall and containing a flow restrictor and a sealing washer. The casing may be threaded on its outside surface for use on faucets with female threads or on its inner surface for use on faucets with male threads.

The flow restrictor is circular and has a conical portion sloping downward and radially inward toward a central opening which forms a first orifice for flow of liquid from the faucet to a chamber formed by the restrictor in conjunction with the bottom and side walls of the casing. The lower end of the restrictor's conical portion forms with the casing's bottom wall an annular second orifice for passage of liquid radially outward from the first orifice into an annular sub-chamber which, due to the restrictor's conical portion, increases substantially in height in the direction radially outward from the second orifice, thereby substantially increasing the sub-chamber's volume. The bottom wall has a central conical recess opposite said first orifice, the conical wall of the recess being arranged to deflect liquid from the first orifice radially outward through the second orifice, preferably by way of a sharp corner of a rib surrounding said recess.

From the enlarged sub-chamber, liquid discharges through the holes in the casing's bottom wall. Those holes are located at different radial distances from the central recess and constitute in sum total a third orifice. The first, second and third orifices are of progressively increasing throughflow area, whereby the static pressure of the liquid upstream from the first orifice is reduced in three steps to a pressure resulting in the desired discharge rate from the casing.

To provide the desired effect of the sub-chamber's enlargement, the conical wall of said central recess forms with the horizontal an angle no greater than the angle formed with the horizontal by the conical lower surface of the restrictor.

BRIEF DESCRIPTION OF THE DRAWINGS

For a more complete understanding of the invention, reference may be had to the following description in conjunction with the accompanying drawing, in which.

DETAILED DESCRIPTION OF THE INVENTION

Figure 2:
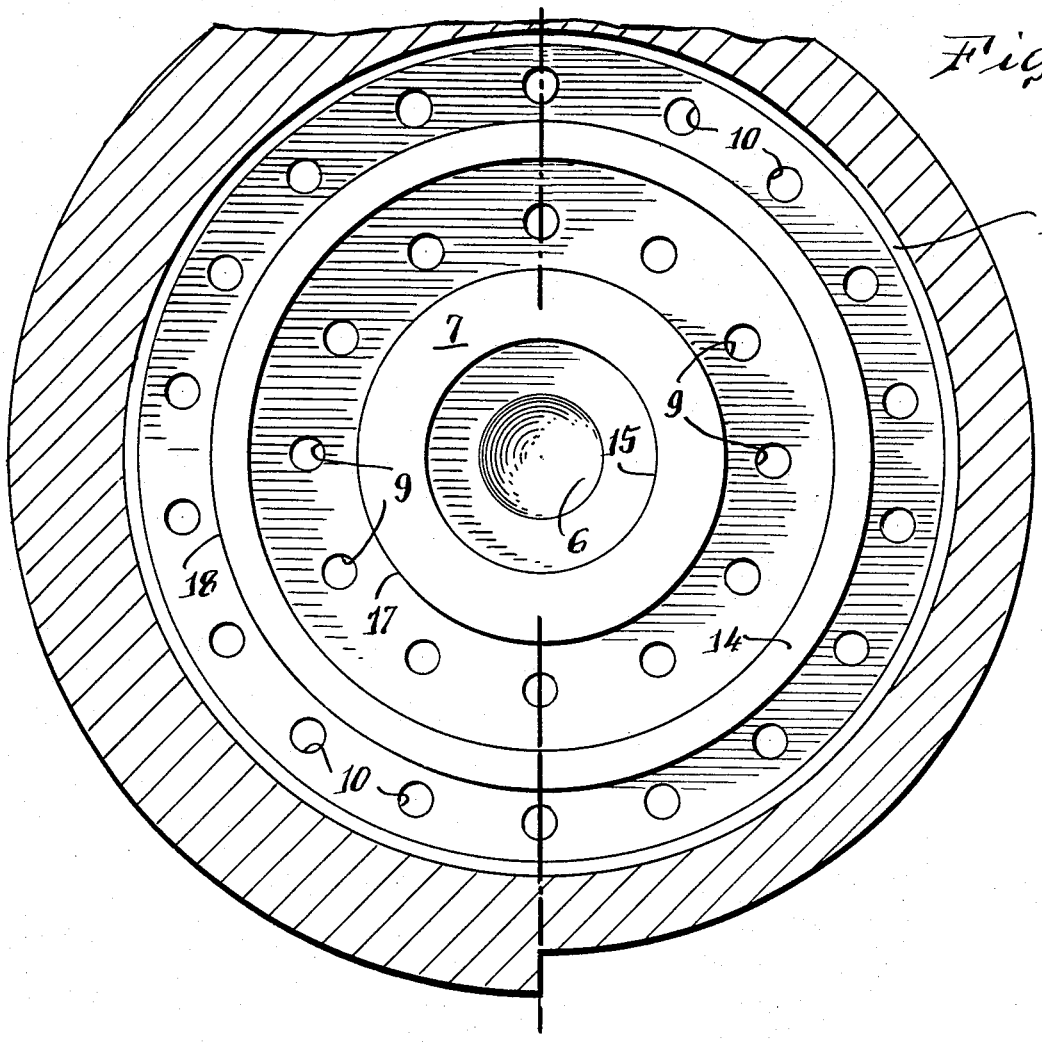
FIG. 1 is a vertical sectional view of a preferred form of the new stream-controlling device and FIG. 2 is a sectional view on line 2—2 in FIG. 1

The device as illustrated comprises a generally cylindrical hollow casing 1 having bottom and side walls and open at the top. The casing has an annular threaded upper portion 1*a* adapted for securing the casing to an annular threaded portion of a faucet (not shown). As shown at the right in FIG. 1, the upper portion 1*a* is internally threaded for securement to an externally threaded faucet; and as shown at the left the upper portion 1*a* is externally threaded for securement to an internally threaded faucet.

A flow restrictor 3 of circular form is mounted in the casing and forms with its bottom and side walls a circular chamber 12, the flow restrictor having a central opening forming a first orifice 5 for passage of liquid from the faucet to chamber 12. Flow restrictor 3 also has a conical portion 4 forming a conical upper surface sloping downwardly and inwardly toward the first orifice 5, this conical portion also forming a conical lower surface sloping upwardly and outwardly from orifice 5. The bottom wall of casing 1 has a central conical recess 6 opposite the first orifice 5.

At the upper portion of chamber 12, the casing's side wall 11 forms a shoulder 11*a* supporting a downwardly-turned peripheral part of restrictor 3. A sealing washer 2 is supported on the restrictor and located radially by the upper internal wall of casing 1. When the device is assembled to a faucet, washer 2 seals against the bottom surface of the faucet to prevent leakage past the connecting threads.

The bottom wall of casing 1 and the lower end of the conical portion 4 of the restrictor define between them an annular second orifice 8, the conical wall of recess 6 being arranged to deflect liquid radially outward from the first orifice 5 through the second orifice 8. The lower surface of restrictor 3 forms with the bottom and side walls of the casing a sub-chamber 12*a* of chamber 12 for receiving liquid from the second orifice 8. Sub-chamber 12*a* increases substantially in height in the radial direction from second orifice 8 toward the casing's side wall 11. Thus, the flow restrictor's conical wall 4 provides for a sub-chamber 12*a* which is substantially enlarged in volume.

Figure 1:
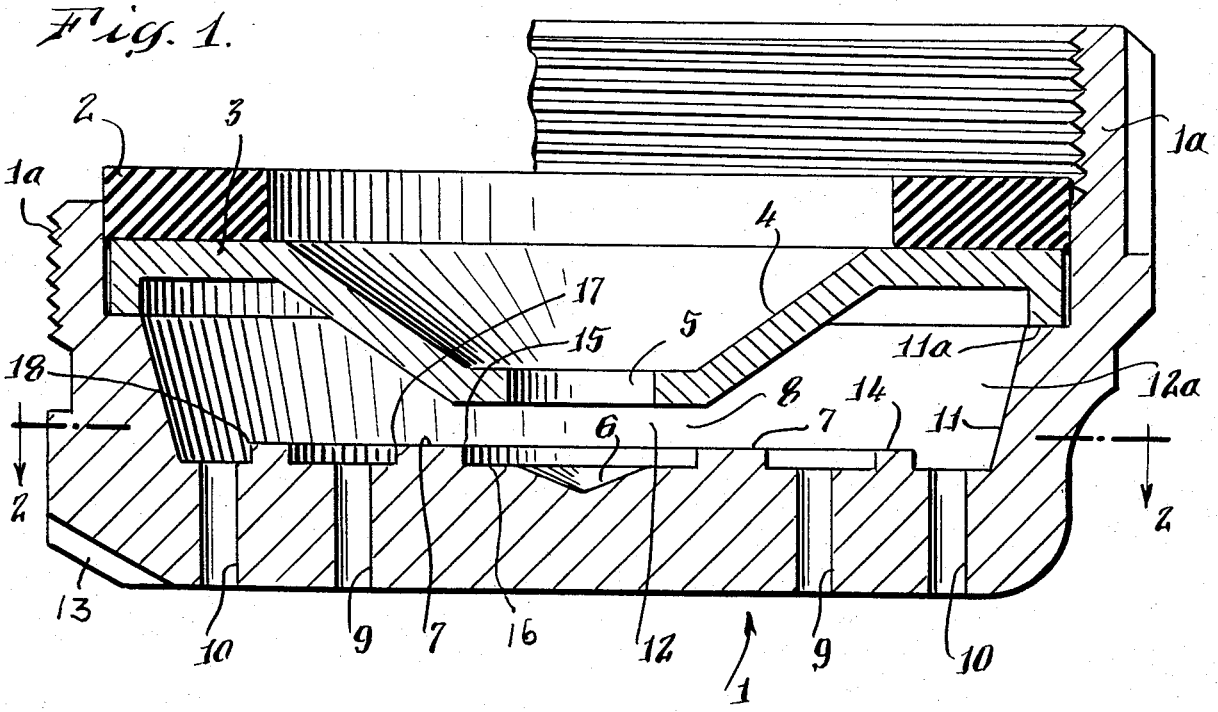

The internal annular surface of side wall 11 of the casing 1 slopes downwardly and inwardly from shoulder 11*a* toward holes 10,9 in the casing bottom wall as shown in FIG. 1.

The bottom wall of casing 1 has a multiplicity of holes located at different radial distances from the conical recess 6. As shown, these holes include an inner circular series of holes 9 surrounding recess 6 and an outer circular series of holes 10 surrounding the first series 9. An inner annular rib 7 of the bottom wall is located between conical recess 6 and the inner series of holes 9, and an outer annular rib 14 of the bottom wall is located between the inner series of holes 9 and the outer series 10. The holes 9 and 10 constitute in sum total a third orifice for discharging liquid from the casing. The throughflow area of this third orifice 9–10 is substantially greater than the throughflow area of the second orifice 8, and the latter throughflow area is substantially greater than that of the first orifice 5.

Each of the ribs 7 and 14 forms a pair of sharp annular corners spaced radially from each other, the corners of inner rib 7 being shown at 15 and 17, and the outer corner of rib 14 being shown at 18. The wall of conical recess 6 is at an angle to the horizontal sufficiently small to deflect liquid from the first orifice 5 directly against the adjacent corner 15 of inner rib 7. Moreover, the conical wall of recess 6 forms with the horizontal an angle no greater than the angle formed with the horizontal by the conical lower surface of restrictor 3.

Water coming from the faucet enters the top of casing 1 and is directed towards restricting orifice 5 by the cone-shaped surface 4 of restrictor 3. Water passing through orifice 5 impinges on cone-shaped surface 6 from which the resulting jet of water is deflected radially outward through the annular second orifice 8 into the enlarged sub-chamber 12*a* forming an intermediate pressure chamber. Water then discharges downward through holes 9–10 which are closely spaced and sufficient in number (e.g., thirty) to form a substantial group of individual jets directed downwards.

The flow rate through the device is controlled by sizing the three orifices 5, 8 and 9–10 to limit the flow rate to the desired maximum. As an example, the orifices are set to limit the flow rate to 2.75 gpm at 80 psi flowing line pressure. Other orifice sizes, of course, can be selected to limit the flow rate to other values.

It is well understood that the mechanism for reducing the discharge of water from an outlet is to introduce flowrestricting orifices. The rate of discharge of a fluid through an orifice is determined by the throughflow (cross-sectional) area of the orifice and the static pressure in the fluid upstream of the orifice. As a fluid is discharged through an orifice there is an energy loss which results in a lower static pressure on the downstream side of the orifice. The series of three orifices 5, 8 and 9–10 function to reduce the pressure in three steps to a pressure which will result in a discharge from the bottom of casing 1 which is in accordance with the selected flow rate standard.

By progressively increasing the throughflow areas of the three orifices, the major burden of reducing flow rate is placed on the first orifice 5 and permits design of the second and third orifices 8 and 9–10 in a fashion to optimize stream straightness and stream quality. It is the combination of the three orifices in series, with increasing cross-sectional areas, that results in a flow-restricted device delivering a discharge that is straight and acceptable in appearance.

The design angle of conical part 4 of restrictor 3, as illustrated, is approximately 35° from the horizontal, and the design angle of conical surface 6 of the casing's bottom wall is approximately 20°. The principle involved here is that the two surfaces defined by these angles are parallel or diverging so that the passageway through orifice 8 has parallel or diverging sides. Any combination of angles will be satisfactory provided that the angles result in a passageway with parallel or diverging sides rather than converging sides. The diverging passageway insures that the second orifice 8 is a controlling orifice and that there is no undefined orifice between orifice 8 and the third discharge orifices 9–10.

The objective of delivering a series of closely spaced individual jets in a single discharge is accomplished in part by providing the inner circle of orifices 9 and the outer circle of orifices 10. It is therefore essential that the flow of water be divided adequately between the inner and the outer circles of orifices. This is accomplished by providing the ribs 7 and 14 on the bottom wall of casing 1. The inner rib 7 assists in guiding the water stream into the sub-chamber 12*a*. The outer rib 14 insures that the water discharging from sub-chamber 12*a* through the sets of orifices 9–10 is divided in the proper proportion between the inner orifices 9 and the outer orifices 10.

The specific function of ribs 7 and 14 will be described in further detail. To provide the sharp corner 15 of rib 7, a flat-bottomed recess 16 surrounds the cone-shaped surface 6. As the jet of water moves through annular orifice 8, the lower surface of the jet barely contacts sharp corner 15. This results in a drop in static pressure above the top surface of rib 7. The drop in static pressure causes the lower portion of the water jet to diverge downwards and assume a more horizontal direction. As this horizontal jet of water moves further out radially, it passes sharp corner 17, and again a drop in static pressure occurs in the valley formed between ribs 7 and 14. This drop in static pressure causes a portion of the horizontal jet of water to turn downward and therefore enter the discharge orifices 9. Other parts of the jet move radially outward and pass across sharp corner 18. Again a drop in static pressure occurs directly outward from sharp corner 18. This also causes an additional portion of the horizontal jet to turn downward and discharge through outer orifices 10.

It can be seen that the sharp corners formed by ribs 7 and 14 serve the function of adequately dividing the flow of water between the inner circle of orifices 9 and the outer circle of orifices 10.

The lower, outer periphery of casing 1 is provided with a series of ribs and grooves 13 which facilitate installation and removal of the device from the faucet. In a male version of the device as shown, there is virtually no casing length exposed below the end of the faucet to provide finger-grip surfaces for installation and removal. The ribs and grooves 13 permit using automatic assembly tools to assemble the device when manufacturing the faucet. They also permit the user of the faucet to more easily remove the device for cleaning and maintenance. They also permit the use of a specially shaped key to enable tightening the device very securely onto a spout in order to minimize theft problems in public washroom facilities.

It should be understood that the materials chosen for casing 1 may be metal or plastic or any other suitable material which meets the engineering and service requirements of the product. Likewise, the material for the restrictor 3 may be of any material suitable to meet the service requirements. The material for the sealing washer 2 must meet engineering requirements for sealing in addition to other engineering requirements. It is conceivable that washer 2 could be combined with diffuser 3 so as to be a single-piece construction.

The dominating feature of the present invention is the enlargement of sub-chamber 12*a* provided by the restrictor's conical portion 4. Included in the prior art is a stream-controlling device somewhat similar to the present one, the most significant difference being that the prior device lacks a flow restrictor with a conical wall portion forming the enlarged sub-chamber 12*a* of the present device. The superior performance of the present device is due to the fact that the enlarged sub-chamber 12*a* provides a sort of reservoir of water which permits dissipation of some of the energy in the stream as it flows through orifice 8, so that the final discharge from orifices 9–10 is a softer stream of well defined individual jets. Moreover, with a flat horizontal wall forming the upper surface of chamber 12 in the prior device, the outer rib 14 forms with this upper surface an additional flow-restricting orifice from which water can discharge only through the outer holes 10, the latter having a total throughflow area less than that of said additional orifice. Further, the conical wall of recess 6 in the prior device converges toward (rather than diverging from) the horizontal upper surface of the confined chamber of the prior device.

I claim:

1. A stream-controlling device for faucets, which comprises a generally cylindrical hollow casing having bottom and side walls and an annular threaded upper portion adapted for securing the casing to an annular threaded portion of a faucet, a flow restrictor of circular form mounted in said casing and forming with said bottom and side walls a circular chamber, the flow restrictor having a central first orifice for passage of liquid from the faucet to said chamber, said restrictor having a conical portion forming a conical upper surface sloping downwardly and inwardly toward said first orifice, said conical portion also forming a conical lower surface sloping upwardly and outwardly from said first orifice, said bottom wall having an imperforate central conical recess opposite said orifice, said bottom wall and the lower end of said conical lower surface defining an annular second orifice, the conical wall of said recess being arranged to deflect liquid from said first orifice radially outward through said second orifice, the lower surface of the restrictor forming with said bottom and side walls an annular sub-chamber of said chamber for receiving liquid from said second orifice, said sub-chamber increasing substantially in height in the radial direction from the second orifice to said side wall, the conical wall of said recess forming with the horizontal an angle no greater than the angle formed by said conical lower surface with the horizontal, said bottom wall having a multiplicity of holes located radially outwardly beyond said imperforate central conical recess and at different radial distances from said conical recess and constituting in sum total a third orifice for discharging liquid from said casing, said holes extending through said bottom wall in a downward direction generally parallel to one another, and said first, second and third orifices being of progressively increasing throughflow area.

2. The device of claim 1, in which said bottom wall includes an inner annular rib surrounding said recess and an outer annular rib surrounding said first rib, said holes including an inner series between said first and second annular ribs and an outer series between said second rib and said side wall.

3. The device of claim 2, in which each rib forms a pair of sharp annular corners spaced radially from each other, the wall of said conical recess being at an angle to the horizontal sufficiently small to deflect liquid from said first orifice directly aganinst the adjacent corner of said inner rib.

4. The device of claim 1, in which said side wall of said casing has an internal annular surface sloping downwardly and inwardly toward said holes.

5. The device of claim 1, in which said side wall of said casing forms at the upper part of said sub-chamber an annular upwardly-facing shoulder on which the flow restrictor is seated.

6. The device of claim 2, in which each rib forms a pair of sharp annular corners spaced radially from each other, the wall of said conical recess being at an angle to the horizontal sufficiently small to deflect liquid from said first orifice directly aganst the adjacent corner of said inner rib, said side wall of said casing having an internal annular surface sloping downwardly and inwardly toward said holes and forming at the upper part of said sub-chamber an annular upwardly-facing shoulder on which the flow restrictor is seated.

* * * * *